US009310078B2

(12) United States Patent
Chen et al.

(10) Patent No.: US 9,310,078 B2
(45) Date of Patent: Apr. 12, 2016

(54) FUEL INJECTION ASSEMBLIES IN COMBUSTION TURBINE ENGINES

(71) Applicant: General Electric Company, Schenectady, NY (US)

(72) Inventors: Wei Chen, Greer, SC (US); Lucas John Stoia, Taylors, SC (US); Richard Martin DiCintio, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 781 days.

(21) Appl. No.: 13/665,182

(22) Filed: Oct. 31, 2012

(65) Prior Publication Data

US 2014/0116053 A1 May 1, 2014

(51) Int. Cl.

| | |
|---|---|
| ***F02C 1/00*** | (2006.01) |
| ***F23R 3/04*** | (2006.01) |
| ***F23R 3/28*** | (2006.01) |
| ***F23R 3/34*** | (2006.01) |

(52) U.S. Cl.
CPC ..... *F23R 3/045* (2013.01); *F23R 3/286* (2013.01); *F23R 3/346* (2013.01)

(58) Field of Classification Search
CPC ..... F23R 3/045; F23R 3/286; F23R 3/346
USPC ..... 60/733, 737, 746
See application file for complete search history.

(56) References Cited

U.S. PATENT DOCUMENTS

| | | | | |
|---|---|---|---|---|
| 3,924,576 | A | 12/1975 | Siewert | |
| 4,351,156 | A * | 9/1982 | White | F23C 6/047 60/737 |
| 4,543,894 | A | 10/1985 | Griswold et al. | |
| 4,603,548 | A | 8/1986 | Ishibashi et al. | |
| 4,955,191 | A | 9/1990 | Okamoto et al. | |
| 4,989,549 | A | 2/1991 | Korenberg | |
| 4,998,410 | A | 3/1991 | Martinez-Leon et al. | |
| 5,054,280 | A | 10/1991 | Ishibashi et al. | |
| 5,076,229 | A | 12/1991 | Stanley | |
| 5,099,644 | A | 3/1992 | Sable et al. | |
| 5,127,229 | A | 7/1992 | Ishibashi et al. | |
| 5,450,725 | A | 9/1995 | Takahara et al. | |
| 5,829,967 | A | 11/1998 | Chyou | |
| 5,878,566 | A | 3/1999 | Endo et al. | |
| 6,289,851 | B1 | 9/2001 | Rabovitser et al. | |
| 6,609,493 | B2 | 8/2003 | Yamaguchi et al. | |
| 6,705,117 | B2 | 3/2004 | Simpson et al. | |
| 6,775,987 | B2 | 8/2004 | Sprouse et al. | |
| 6,925,809 | B2 * | 8/2005 | Mowill | F23R 3/26 431/186 |
| 7,040,094 | B2 | 5/2006 | Fischer et al. | |
| 8,381,532 | B2 * | 2/2013 | Berry | F01D 9/06 60/751 |

(Continued)

*Primary Examiner* — Charles Freay

(74) *Attorney, Agent, or Firm* — Mark E. Henderson; Ernest G. Cusick; Frank A. Landgraff

(57) ABSTRACT

An assembly for use in a fuel injection system within a combustor of a combustion turbine engine is described. The assembly may include: a first port formed through an outer radial wall of the combustor and a second port formed through an inner radial wall. A plenum may be formed about the first port. A tube may be formed that has a first end positioned within the first port and a second end positioned within the second port. At the first end, the tube may be sized smaller than the first port such that two passages are defined therethrough: a first passage defined about an exterior of the tube; and a second passage defined through an interior of the tube.

22 Claims, 6 Drawing Sheets

(56) References Cited

U.S. PATENT DOCUMENTS

| | | | | |
|---|---|---|---|---|
| 8,701,383 | B2 * | 4/2014 | Venkataraman | F02C 7/22 60/39.37 |
| 9,010,120 | B2 * | 4/2015 | DiCintio | F23R 3/06 60/746 |
| 9,097,424 | B2 * | 8/2015 | Chen | F23R 3/045 |
| 2001/0049932 | A1 | 12/2001 | Beebe | |
| 2002/0148230 | A1 * | 10/2002 | Halila | F23R 3/343 60/796 |
| 2003/0010035 | A1 | 1/2003 | Farmer et al. | |
| 2003/0024234 | A1 | 2/2003 | Holm et al. | |
| 2007/0234733 | A1 | 10/2007 | Harris et al. | |
| 2008/0072599 | A1 | 3/2008 | Morenko et al. | |
| 2008/0264033 | A1 | 10/2008 | Lacy et al. | |
| 2009/0084082 | A1 | 4/2009 | Martin et al. | |
| 2010/0170216 | A1 | 7/2010 | Venkataraman et al. | |
| 2010/0170219 | A1 | 7/2010 | Venkataraman et al. | |
| 2010/0170251 | A1 | 7/2010 | Davis, Jr. et al. | |
| 2010/0170252 | A1 | 7/2010 | Venkataraman et al. | |
| 2010/0170254 | A1 | 7/2010 | Venkataraman et al. | |
| 2010/0174466 | A1 | 7/2010 | Davis, Jr. et al. | |
| 2010/0229557 | A1 * | 9/2010 | Matsumoto | F23R 3/346 60/737 |
| 2010/0242482 | A1 * | 9/2010 | Kraemer | F02C 7/228 60/746 |

* cited by examiner

FUEL INJECTION ASSEMBLIES IN COMBUSTION TURBINE ENGINES

BACKGROUND OF THE INVENTION

The present invention relates to combustion turbine engines, and more particularly, to fuel injectors disposed downstream of primary fuel nozzles in the combustion systems.

Multiple designs exist for staged combustion in combustion turbine engines, but most are complicated assemblies consisting of a plurality of tubing and interfaces. One kind of staged combustion used in combustion turbine engines is often referred to as "late lean injection." In this type of staged combustion, late lean fuel injectors are located downstream of the primary fuel nozzle. As one of ordinary skill in the art will appreciate, combusting a fuel/air mixture at this downstream location may be used to improve NOx performance. NOx, or oxides of nitrogen, is one of the primary undesirable air polluting emissions produced by combustion turbine engines that burn conventional hydrocarbon fuels. The late lean injection may also function as an air bypass, which may be used to improve carbon monoxide or CO emissions during "turn down" or low load operation. It will be appreciated that late lean injection systems may provide other operational benefits.

Conventional late lean injection assemblies are expensive and costly for both new gas turbine units and retrofits of existing units. One of the reasons for this is the complexity of conventional late lean injection systems, particularly those systems associated with the fuel and air delivery. The many parts associated with these complex systems must be designed to withstand the extreme thermal and mechanical loads of the turbine environment, which significantly increases manufacturing and installation cost. Even so, conventional late lean injection assemblies still have a high risk for fuel leakage into the compressor discharge casing, which can result in auto-ignition and a safety issue.

Additionally, conventional late lean injectors perform poorly in regard to providing a well-mixed fuel/air mixture for combustion within the combustion chamber. Further, conventional designs fail to efficiently use air supplied from within the flow annulus formed of the combustor.

As a result, there is a need for improved late lean injection systems and components, particularly those that reduce system complexity, assembly time, and manufacturing cost, while also performing effectively and making efficient usage of the air supply flowing through this region of the turbine. Additionally, such injection systems should restrict the backflow of fluid within the passage that traverses the flow annulus within the combustor so to limit the occurrence of flameholding.

BRIEF DESCRIPTION OF THE INVENTION

The present application thus describes an assembly for use in a fuel injection system within a combustor of a combustion turbine engine. The combustor may include an inner radial wall, which defines a primary combustion chamber downstream of a primary fuel nozzle, and an outer radial wall, which surrounds the inner radial wall so to form a flow annulus therebetween. The fuel injection assembly may further include: a first port formed through the outer radial wall; a second port formed through the inner radial wall; a plenum formed about the first port, the plenum comprising a volume disposed outboard of an outer surface of the outer radial wall; a tube comprising a first end positioned within the first port and a second end positioned within the second port, wherein at the first end, wherein the tube is sized smaller than the first port such that two passages are defined therethrough: a first passage defined about an exterior of the tube; and a second passage defined through an interior of the tube; and fuel outlets disposed within the first passage. These and other features of the present application will become apparent upon review of the following detailed description of the preferred embodiments when taken in conjunction with the drawings and the appended claims.

BRIEF DESCRIPTION OF THE DRAWINGS

These and other features of this invention will be more completely understood and appreciated by careful study of the following more detailed description of exemplary embodiments of the invention taken in conjunction with the accompanying drawings, in which.

DETAILED DESCRIPTION OF THE INVENTION

Figure 1:
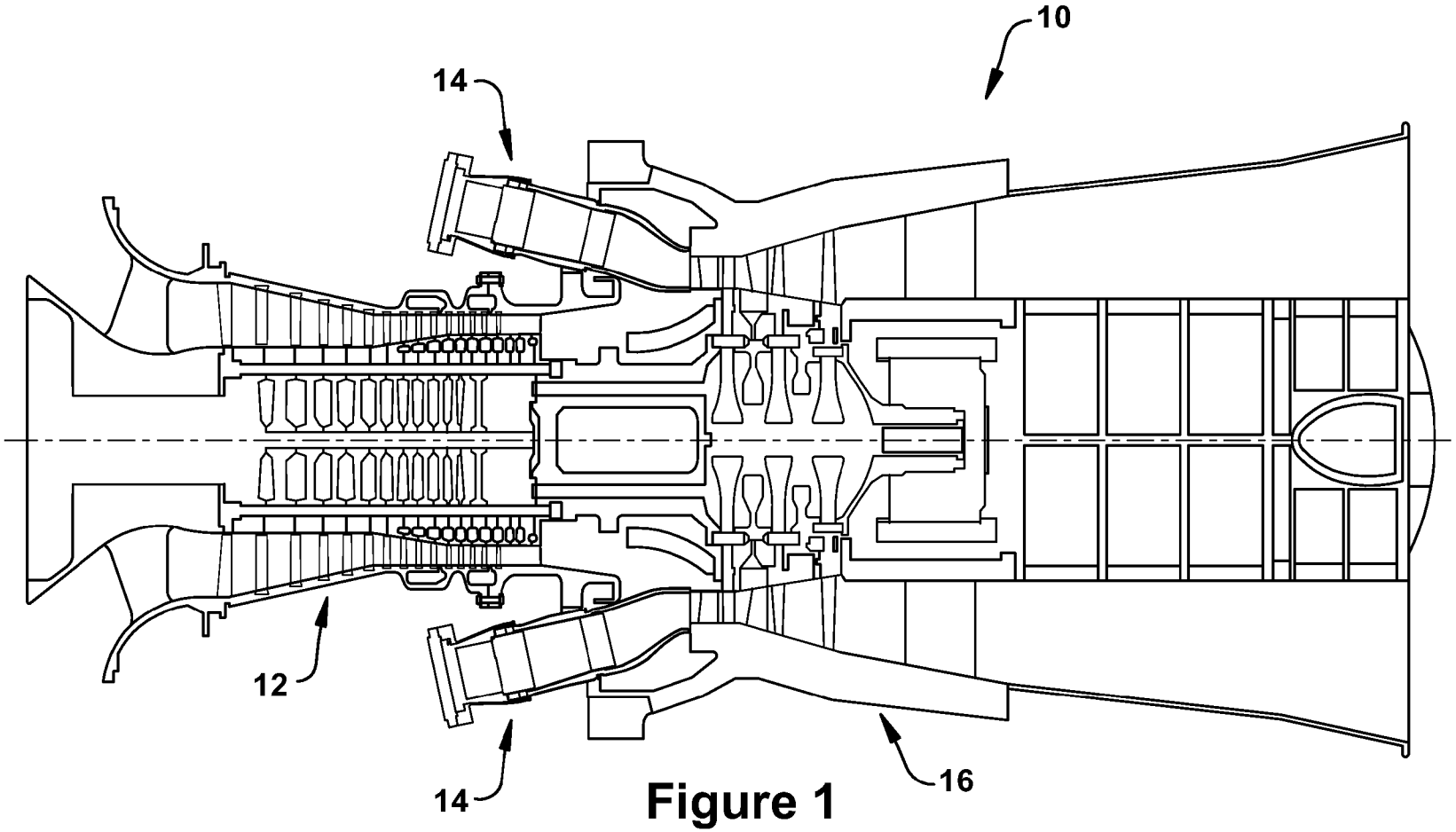
Figure 1 (Prior Art)
FIG. 1 is a section view of a combustion turbine system in which embodiments of the present invention may be used.

As an initial matter, in order to clearly delineate the invention of the current application, it may be necessary to select terminology that refers to and describes certain parts or machine components within a combustion turbine engine. Whenever possible, common industry terminology will be used and employed in a manner consistent with its accepted meaning. However, it is meant that any such terminology be given a broad meaning and not narrowly construed such that the meaning intended herein and the scope of the appended claims is unreasonably restricted. Those of ordinary skill in the art will appreciate that often a particular component may be referred to using several different terms. In addition, what may be described herein as being single part may include and be referenced in another context as consisting of multiple components, or, what may be described herein as including multiple components may be referred to elsewhere as a single part. As such, in understanding the scope of the present invention, attention should not only be paid to the terminology and description provided herein, but also to the structure, configuration, function, and/or usage of the component, particularly as provided in the appended claims.

In addition, several descriptive terms may be used regularly herein, and it should prove helpful to define these terms at the onset of this section. Accordingly, these terms and their definitions, unless stated otherwise, are as follows. As used herein, "downstream" and "upstream" are terms that indicate a direction relative to the flow of a fluid, such as the working fluid through the turbine engine or, for example, the flow of air through the combustor or coolant through one of the turbine's component systems. As such, the term "downstream" corresponds to the direction of flow of the fluid, and the term "upstream" refers to the direction opposite to the flow. The terms "forward" and "aft", without any further specificity, refer to directions, with "forward" referring to the forward or compressor end of the engine, and "aft" referring to the aft or turbine end of the engine. In the case of the combustor, it will be appreciated that the forward end is the headend, and the aft end is the outlet of the transition piece. The term "radial" refers to movement or position perpendicular to an axis. It is often required to describe parts that are at differing radial positions with regard to a center axis. In cases such as this, if a first component resides closer to the axis than a second component, it will be stated herein that the first component is "radially inward" or "inboard" of the second component. If, on the other hand, the first component resides further from the axis than the second component, it may be stated herein that the first component is "radially outward" or "outboard" of the second component. The term "axial" refers to movement or position parallel to an axis. Finally, the term "circumferential" refers to movement or position around an axis. It will be appreciated that such terms may be applied in relation to the center axis of the turbine, or, when referring to components within a combustor, the center axis of the combustor.

Turning again to the figures, FIG. 1 is an illustration showing a typical combustion turbine system 10. The gas turbine system 10 includes a compressor 12, which compresses incoming air to create a supply of compressed air, a combustor 14, which burns fuel so as to produce a high-pressure, high-velocity hot gas, and a turbine 16, which extracts energy from the high-pressure, high-velocity hot gas entering the turbine 16 from the combustor 14 using turbine blades, so as to be rotated by the hot gas. As the turbine 16 is rotated, a shaft connected to the turbine 16 is caused to be rotated as well, the rotation of which may be used to drive a load. Finally, exhaust gas exits the turbine 16.

Figure 2:
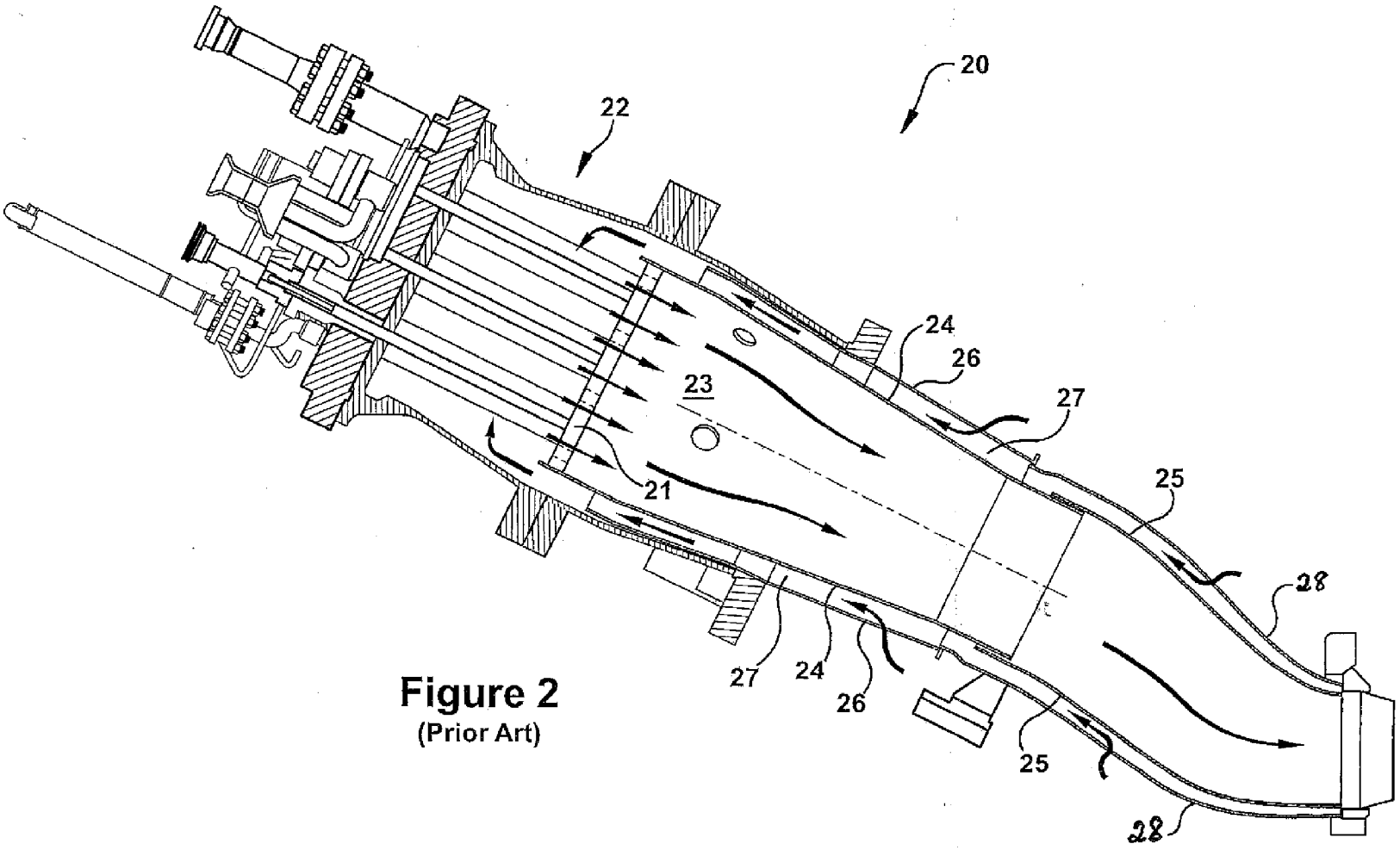
Figure 2 (Prior Art)
FIG. 2 is a section view of a conventional combustor in which embodiments of the present invention may be used.

FIG. 2 is a section view of a conventional combustor in which embodiments of the present invention may be used. Though the combustor 20 may take various forms, each of which being suitable for including various embodiments of the present invention, typically, the combustor 20 typically includes a head end 22, which includes multiple fuel nozzles 21 that bring together a flow of fuel and air for combustion within a primary combustion zone 23, which is defined by a surrounding liner 24. The liner 24 typically extends from the head end 22 to a transition piece 25. The liner 24, as shown, is surrounded by a flow sleeve 26. The transition piece 25 is surrounded by an impingement sleeve 28. Between the flow sleeve 26 and the liner 24 and the transition piece 25 and impingement sleeve 28, it will be appreciated that an annulus, which will be referred to herein as a "flow annulus 27", is formed. The flow annulus 27, as shown, extends for a most of the length of the combustor 20. From the liner 24, the transition piece 25 transitions the flow from the circular cross section of the liner 24 to an annular cross section as it travels downstream to the turbine section (not shown). At a downstream end, the transition piece 25 directs the flow of the working fluid toward the airfoils that are positioned in the first stage of the turbine 16.

It will be appreciated that the flow sleeve 26 and impingement sleeve 27 typically has impingement apertures (not shown) formed therethrough which allow an impinged flow of compressed air from the compressor 12 to enter the flow annulus 27 formed between the flow sleeve 26/liner 24 and/or the impingement sleeve 28/transition piece 25. The flow of compressed air through the impingement apertures convectively cools the exterior surfaces of the liner 24 and transition piece 25. The compressed air entering the combustor 20 through the flow sleeve 26 and the impingement sleeve 28 is directed toward the forward end of the combustor 20 via the flow annulus 27 formed about the liner 24. The compressed air then enters the fuel nozzles 21, where it is mixed with a fuel for combustion within the combustion zone 23. As noted above, the turbine engine 16 includes a turbine 16 having circumferentially spaced rotor blades, into which products of the combustion of the fuel in the combustor are directed. The transition piece 25 directs the flow of combustion products of the liner 24 into the turbine 16, where it interacts with the rotor blades to induce rotation about the shaft, which, as stated, then may be used to drive a load, such as a generator. Thus, the transition piece 25 serves to couple the combustor 20 and the turbine 16. In systems that include late lean fuel injection, as discussed below, it will be appreciated that the transition piece 25 also may define a secondary combustion zone in which additional fuel supplied thereto is combusted.

Figure 3:
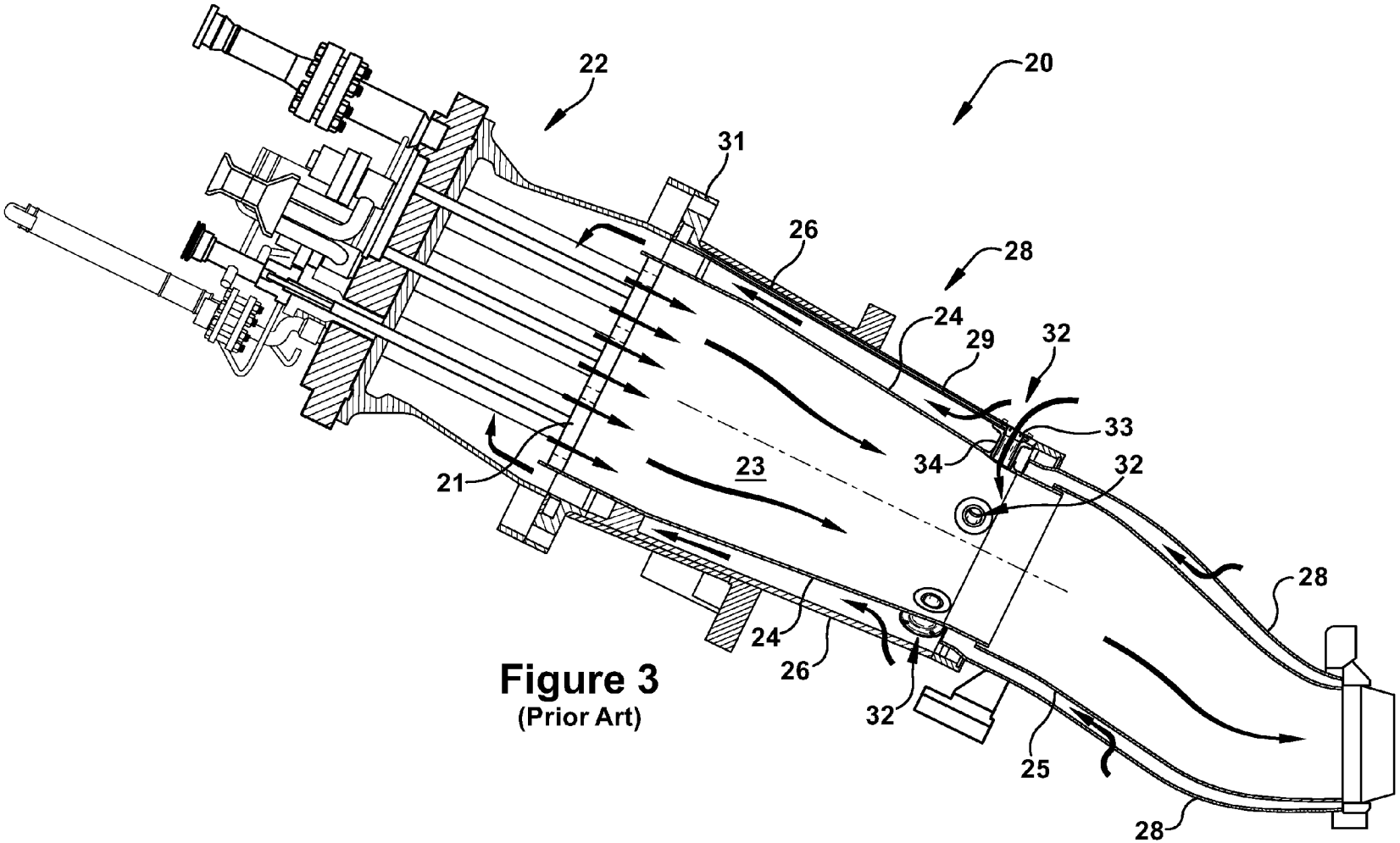
Figure 3 (Prior Art)
FIGS. 3 is a section view of a combustor that includes fuel injectors according to conventional design.
Figure 4:
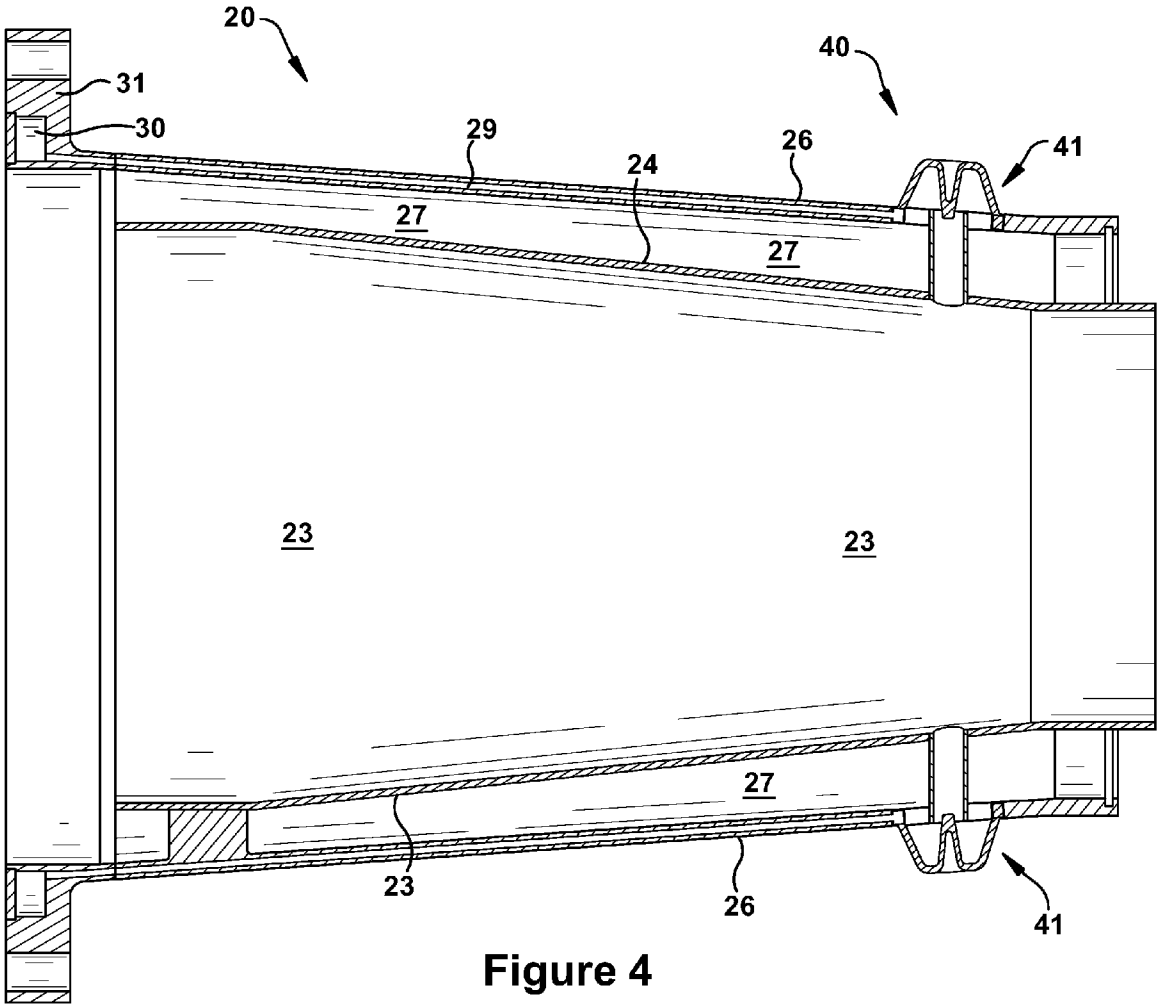
FIG. 4 is a section view of a flow sleeve and liner assembly that includes a fuel injection assembly and fuel injectors according to an embodiment of the present invention.

FIG. 3 provides a view of a fuel injection system 28, which often is referred to as a "late lean injection system", according to a conventional design. As shown in FIG. 3, the conventional fuel injection system 28 may include a fuel passageway 29 defined within the flow sleeve 26, though other types of fuel delivery are possible. The fuel passageway 29 may originate at a fuel manifold 30 defined within a flow sleeve flange 31, which is positioned at the forward end of the flow sleeve 26. The fuel passageway 29 may extend from the fuel manifold 30 to a fuel injector 32. The fuel injectors 32 may be positioned at or near the aft end of the flow sleeve 26. According to certain embodiments, the fuel injectors 32 include a nozzle 33 and a transfer tube 34 that extends across the flow annulus 27. In general, the nozzle 33 and the transfer tube 34 bring together a supply of compressed air derived from the exterior of the flow sleeve 26 and a supply of fuel delivered via multiple outlets positioned in the nozzle 33 and inject this mixture into the combustion zone 23 within the liner 24. That is, the transfer tube 34 carries the fuel/air mixture across the flow annulus 27 and the mixture is directed into the flow of hot gas within the liner 24, where it combusts. As discussed in more detail below, disadvantages associated with such conventional design include inefficient usage of the compressed air. Specifically, conventional designs use compressed air from outside the combustor 20, as shown in FIG. 3, which has yet to enter the flow annulus 27 and, therefore, has not been used for cooling purposes. Further, the route traveled by the fuel/air mixture before injection in conventional design (i.e., the path between the point at which the fuel and air are brought together and the point at which the fuel and air are injected into the combustion zone 23) is relatively short and linear, which results in a poorly mixed fuel/air combination and, therefore, less than optimum combustion within the combustion zone 23.

FIGS. 4 through 7 provides various views of fuel injection systems or late lean fuel injection systems (referred to generally herein as "fuel injection system 40) according to exemplary embodiments of the present invention. As used herein, a "late lean fuel injection system" is a system for injecting a mixture of fuel and air into the flow of working fluid at a point downstream of the primary fuel nozzles 21 and upstream of the turbine 16. In certain embodiments, a "late lean fuel injection system" is more specifically defined as a system for injecting a fuel/air mixture into the aft end of the primary combustion chamber defined by the liner 24. In general, one of the objectives of late lean fuel injection systems includes enabling fuel combustion occurring downstream of primary combustors/primary combustion zone. This type of operation may be used to improve NOx performance, however, as one of ordinary skill in the relevant art will appreciate, combustion that occurs too far downstream may result in undesirable higher CO emissions. As described in more detail below, the present invention provides effective alternatives for achieving improved NOx emissions, while avoiding certain undesirable results. The present invention further provides a simple assembly for integrating late lean fuel injection into the combustion liner of a gas turbine.

Aspects of the present invention provide performance enhancing ways in which a fuel/air mixture may be injected into aft areas of the combustion zone 23 and/or liner 24. As shown, the fuel injection system 40 may include a fuel passageway 29 defined within the flow sleeve 26. In one example, the fuel passageway 29 originates at a fuel manifold 30 defined within a flow sleeve flange 31, which is positioned at the forward end of the flow sleeve 26. The fuel passageway 29 may extend from the fuel manifold 30 to a fuel injector 41. As shown the fuel injectors 41 may be positioned at or near the aft end of the flow sleeve 26, though other configurations are possible. In a preferred embodiment, there may be several fuel injectors 41 positioned circumferentially around the flow sleeve 26/liner 24 assembly so that a fuel/air mixture is introduced at multiple points around the combustion zone 23.

It will be appreciated that the fuel injectors 41 may also be installed in similar fashion at positions further forward or aft in a combustor 14 than those shown in the various figures, or, for that matter, anywhere where a flow assembly is present that has the same basic configuration as that described above for the liner 24/flow sleeve 26 assembly. For example, using the same basic components, the fuel injector 41 also may be positioned within the transition piece 25/impingement sleeve 28 assembly. In this instance, the fuel passageway 29 may be extended to make the connection with fuel injector 41, and the fuel/air mixture may be injected into the hot-gas flow path within the transition piece 25. As one of ordinary skill in the art will appreciate, this configuration may be advantageous given certain criteria and operator preferences. While the several provided figures are directed toward an exemplary embodiment within the liner 24/flow sleeve 26 assembly, it will be appreciated that this is not meant to be limiting. Accordingly, when the description below refers to an "outer radial wall", it will be appreciated that, unless stated otherwise, this could refer to a flow sleeve 26, an impingement sleeve 28, or similar component. And when the description below refers to an "inner radial wall", it will be appreciated that, unless stated otherwise, this could refer to the liner 24, the transition piece 25, or similar component.

Embodiments of the present invention include a first port 42 formed through the outer radial wall, and a second port 43 formed through the inner radial wall. A plenum 44 may be formed about the first port 42 such that the plenum 44 includes an enclosed volume disposed, at least in part, outboard of the outer surface of the outer radial wall, as illustrated. In an alternative, the plenum may be disposed such that no portion resides outboard of the outer surface of the outer radial wall. A tube may be included that includes a first end positioned within the first port 42 and a second end positioned within the second port 43. At the first end, the tube 45 may be smaller than the first port 42 such that two passages are defined through the first port 42: a first passage 48 defined about the exterior of the tube 45 (i.e., between the tube 45 and the edge of the first port 42); and a second passage 49 defined through an interior of the tube 45. The present invention may include one or more fuel outlets 51 defined within the second passage 49.

The present invention may include a plurality of vanes 47 that span across the first passage 48. Each of the vanes 47 may extend from a connection to the edge of the first port 42 to a connection to the outer surface of the tube 45. In certain preferred embodiments, the vanes 47 are regularly spaced around the tube 45 and support the first end of the tube 45 in a fixed central position within the first port 42. The fuel outlets 51 may be positioned on the vanes 47. In certain preferred embodiments, a fuel plenum 52 is position within the outer radial wall so that it surrounds the first port 42. Each fuel outlet 51 may be configured to fluidly communicate with the fuel plenum 52 via channels formed within the vanes 47. The fuel plenum 52 may include a connection to the fuel passageway 29, and the fuel supply to the fuel injector 41 may be supplied via these described passages.

Figure 5:
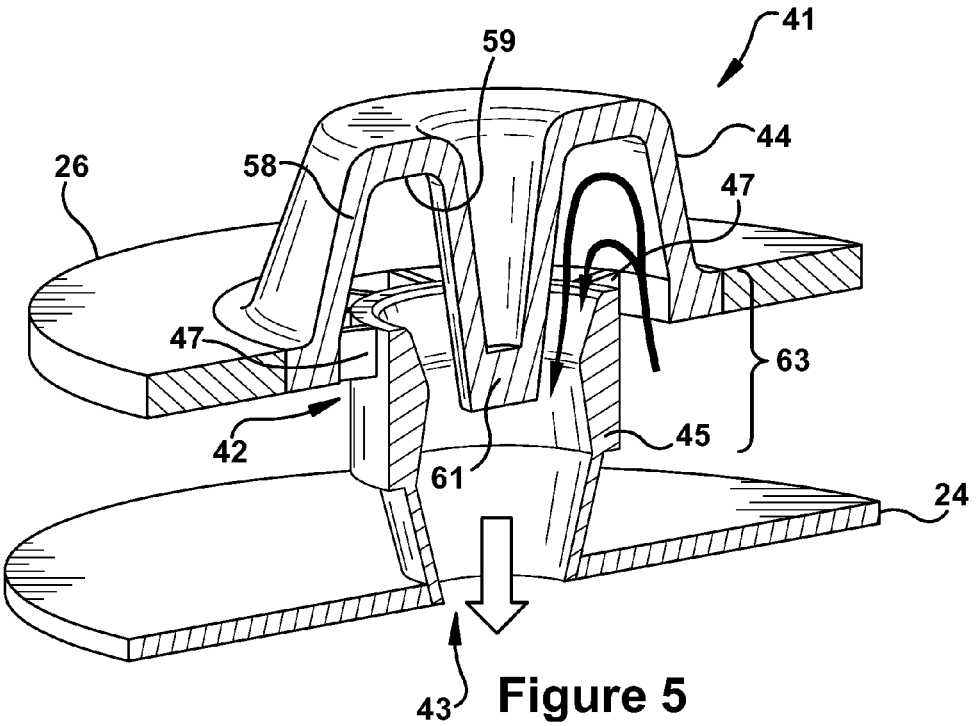
FIG. 5 is a perspective view of a fuel injector according to an embodiment of the present invention.
Figure 6:
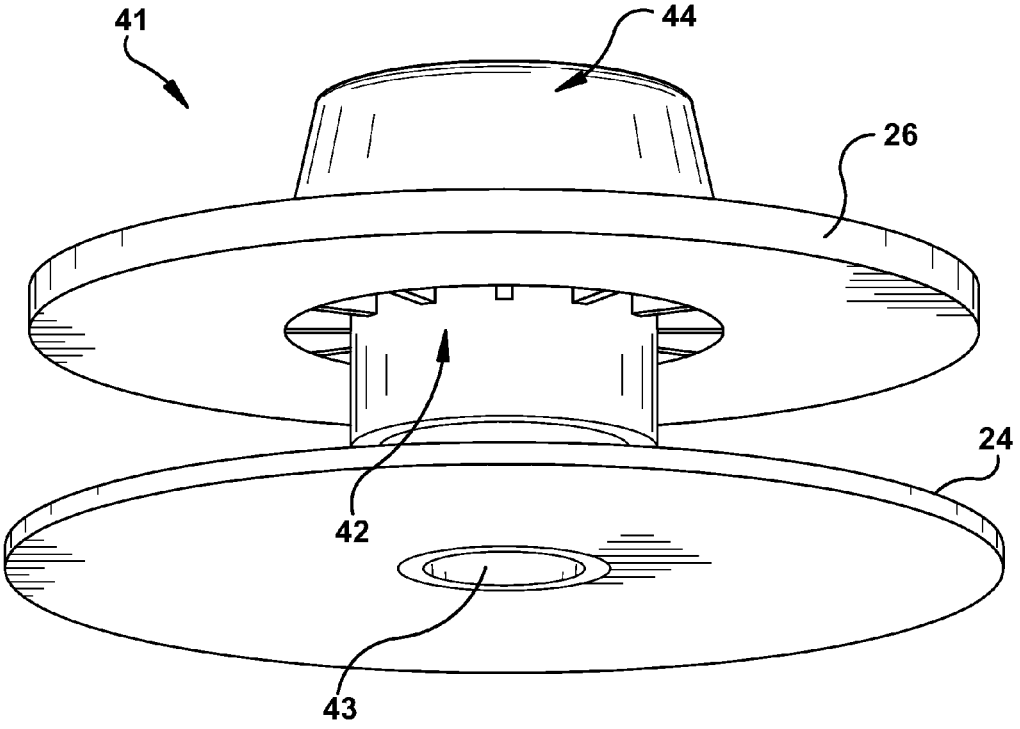
FIG. 6 is an alternative perspective view of a fuel injector according to an embodiment of the present invention.
Figure 7:
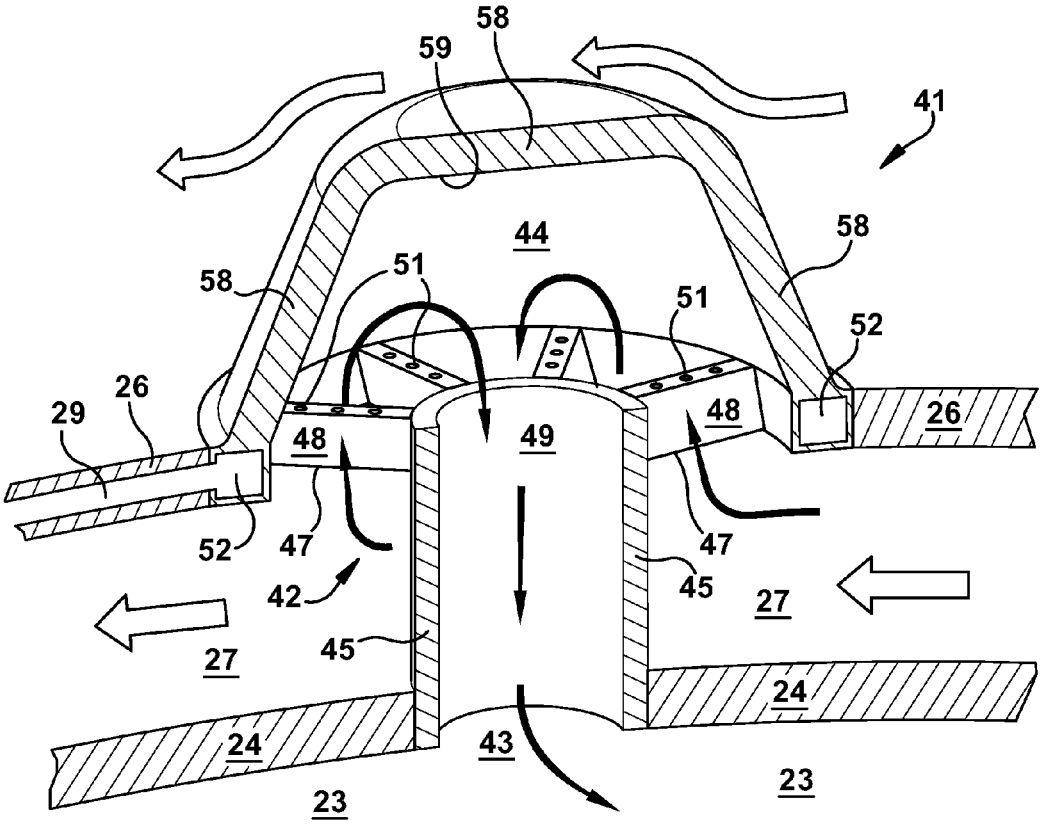
FIG. 7 is a section view of a fuel injector according to an exemplary embodiment of the present invention.

As illustrated, in certain preferred embodiments, each of the vanes 47 may be a fin or have a fin-like shape. It will be appreciated that each of the fins may include an upstream edge and a downstream edge. The fuel outlets 51 may be positioned on the upstream edge, the downstream edge, or both. As illustrated in FIGS. 5 and 6, each vane 47 may be aligned substantially parallel to a center axis of the first port 42. In certain preferred embodiments, as shown in FIG. 7, each vane 47 may be canted in relation to a center axis of the first port 42. It will be appreciated that this will cause a swirling flow to the air moving from the flow annulus 27 to the plenum 44 (i.e., air moving through the first passage 48), which may be used to mix the fuel and air more effectively.

The tube 45 may be configured so that the outboard edge of the first end resides approximately coplanar to the plane of the first port 42, an example of which is shown in FIG. 7. In other embodiments, as shown in FIG. 5, the edge of the first end of the tube 45 may be made to extend to a position just outboard of the plane of the first port 42.

The cross-sectional shape of the first end of the tube 45 may be circular or elliptical (hereinafter "roughly circular") in shape. The cross-sectional shape of the first port 42 also may be roughly circular. The relative flow areas through the first passage 49 and the second passage 48 may be configured to enhance flow therethrough. That is, the first end of the tube 45 and the first port 42 may be configured so that the cross-sectional flow area of the first passage 48 is proportionally desirable to the cross-sectional flow area of the second passage 49. In certain preferred embodiments, the cross-sectional flow area of the second passage 49 is approximately 5 to 8 times the cross-sectional flow area of the first passage 48.

The plenum 44, as illustrated, may be defined by a plenum wall 58. The plenum wall 58 may extend outboard from a footprint defined on the outer surface of the outer radial wall. As shown, the plenum wall 58 may form a dome or mushroom shape. In certain preferred embodiments, as illustrated, the plenum wall 58 extends outboard and tapers gradually to a plenum ceiling 59, which defines the outer radial boundary of the plenum 44. As shown in FIG. 5, in certain preferred embodiments, the plenum ceiling 59 includes an inboard extending flow guide 61. The flow guide 61 may be configured to have a center axis approximately aligned with a center axis of the tube 45. It will be appreciated that the flow guide 61 assists in redirecting the flow of compressed air through the plenum 44 from a substantially outboard direction to a substantially inboard direction. The flow guide 61 may have a circular cross-sectional shape that tapers to a distal end. The flow guide 61 may be configured such that the distal end is positioned inboard or just inboard of the plane of the first port 42.

In certain preferred embodiments, the footprint of the plenum wall 58 also may have a rough circular shape. In certain preferred embodiments, the footprint of the plenum wall 58, the first end of the tube 45, and the first port 42 each comprise the same or similar rough circular shape. In such cases, the footprint of the plenum wall 58, the first end of the tube 45, and the first port 42 may have a concentric arrangement, as illustrated.

As included in FIG. 5, between the first end and the second end, the tube 45 may include a venturi section 63. Extending from an outboard position, the venturi section 63, as illustrated, may include a converging section that converges to a throat (i.e., the narrow point through the tube 45). As it extends further inboard from the throat, the venturi section 63 includes a diverging section. It will be appreciated that the venturi section 63 may induce further air/fuel mixing, as well as reducing the risk of flame flashback through the fuel injector 41. As shown, the venturi section 63 may be configured such that the plane of the throat is positioned at or near the plane of the first port 42, though other configurations are also possible.

Between the first end and the second end, the tube 45 may have an enclosed or solid structure. That is, the tube 45 may be configured such that a fluid moving through the tube 45 is isolated from the cross flow of fluid moving through the flow annulus 27. Similarly, the plenum wall 58 may be configured so that it also is a closed, solid structure. Specifically, the plenum wall 58 may be configured such that a fluid moving through the plenum 44 is isolated from a fluid moving along the outer surface of the outer radial wall as well as the outer surface of the plenum wall 58.

As stated, in preferred embodiments, the inner radial wall is the liner 24 and the outer radial wall is the flow sleeve 26 of the combustor assembly 20. In an alternate arrangement, the inner radial wall is the transition piece 25 and the outer radial wall is the impingement sleeve 28 of a combustor assembly. It will be appreciated that the number of fuel injectors 41 may be varied, depending on the fuel supply requirements and optimization of the combustion process.

In usage, it will be appreciated that the fuel injection system 40 of the present invention may operate as follows. A supply of fuel is delivered to the fuel outlet 51 positioned within the first passage 48 (i.e., the passage defined between the tube 45 and edge of the first port 48), while compressed air is delivered to the first passage 48 via the connection the first passage 48 makes to the flow annulus 27. As illustrated, the first passage 48 surrounds the tube 45 so that air may enter the plenum 44 from the downstream side of the tube 45 (relative to the flow direction of air within the flow annulus 27), as the arrows of FIG. 7 indicate. It will be appreciated that this configuration alleviates aerodynamic losses that would otherwise be present at the backside of an obstruction of this type occurring in the flow annulus 27. The fuel and compressed air brought together within the first passage 48 then flow into the plenum 44, where further mixing occurs. The mixture of fuel and air then exits the plenum 44 through the second passage 48 (i.e., the interior of the tube 45). The tube 45 spans the flow annuls 27 and delivers the fuel/air mixture to the combustion zone 23 where it is combusted. It will be appreciated that this type of operation provides certain performance advantages over conventional designs. As discussed, conventional injectors typically use air from outside the flow sleeve 26 for the necessary supply. It will be appreciated that such air, which would have otherwise entered the flow annulus 27 through the flow sleeve 26, has yet to provide meaningful cooling to the combustor assembly. The usage by the present invention of air that has already entered the flow annulus 27 through the impingement sleeve 28 avoids this result, thereby increasing the cooling efficiency for compressed air moving through this region of the engine.

In addition, certain embodiments of the present invention provide an effective manner by which the air and fuel are mixed before being injected into the combustion zone 23. Specifically, the flow path for the air/fuel mixture is lengthened by detouring the mixture into a plenum 44 located outboard of the flow sleeve 26. The flow path of the present invention results in a greater degree of mixing, a more uniform fuel/air mixture, and, thus, better combustion characteristics once injected into the combustion zone 23. It will be appreciated that without the plenum 44 configuration of the present invention, usage of compressed air from the flow annulus 27 would have a very short and direct path to the combustion zone 23, which would result in a poorly mixed air/fuel mixture.

In this manner, additional fuel and air may be added to the flow of hot combustion gases moving through the interior of the liner 24 and combusted therein, which adds energy to the flow of working fluid before it is expanded through the turbine 16. In addition, as described above, the addition of the fuel and air in this manner may be used to improve NOx emissions as well as achieve other operational objectives.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. An assembly for use in a fuel injection system within a combustor of a combustion turbine engine, wherein the combustor includes an inner radial wall, which defines a primary combustion chamber downstream of a primary fuel nozzle, and an outer radial wall, which surrounds the inner radial wall so to form a flow annulus therebetween, the assembly comprising:

a first port formed through the outer radial wall;

a second port formed through the inner radial wall;

a plenum formed about the first port, the plenum comprising a volume disposed outboard of an outer surface of the outer radial wall;

a tube comprising a first end positioned within the first port and a second end positioned within the second port, wherein at the first end, the tube is sized smaller than the first port such that two passages are defined therethrough: a first passage defined about an exterior of the tube; and a second passage defined through an interior of the tube; and fuel outlets disposed within the first passage.

2. The fuel injection assembly according to claim 1, further comprising vanes spanning across the first passage, each of the vanes extending from a connection to an edge of the first port to a connection to an outer surface of the tube.

3. The fuel injection assembly according to claim 2, wherein the vanes are spaced around the tube and support the first end of the tube in a fixed central position within the first port.

4. The fuel injection assembly according to claim 3, wherein the fuel outlets are disposed on the vanes.

5. The fuel injection assembly according to claim 4, further comprising a fuel plenum positioned within the outer radial wall that surrounds the first port;

wherein each fuel outlet is configured to fluidly communicate with the fuel plenum via channels formed within the vanes; and wherein the fuel plenum includes a connection to a fuel source.

6. The fuel injection assembly according to claim 5, wherein each of the vanes comprises a fin.

7. The fuel injection assembly according to claim 6, wherein each of the fins include an upstream edge and a downstream edge; and wherein each of the vanes includes at least one fuel outlet positioned on one of the upstream edge and the downstream edge of the fin.

8. The fuel injection assembly according to claim 6, wherein each fin is aligned substantially parallel to a center axis of the first port.

9. The fuel injection assembly according to claim 6, wherein each fin is canted in relation to a center axis of the first port so to produce a swirling flow to a fluid passing through the first passage.

10. The fuel injection assembly according to claim 3, wherein an edge of the first end of the tube resides approximately coplanar to the first port.

11. The fuel injection assembly according to claim 3, wherein an edge of the first end of the tube extends to a position just outboard of a plane of the first port.

12. The fuel injection assembly according to claim 3, wherein a cross-sectional shape of the first end of the tube is roughly circular; and wherein a cross-sectional shape of the first port is roughly circular.

13. The fuel injection assembly according to claim 12, wherein the plenum is defined by a plenum wall that extends outboard from a footprint on the outer surface of the outer radial wall.

14. The fuel injection assembly according to claim 13, wherein the plenum wall comprises a dome shape; and wherein the first end of the tube and the first port are configured such that a cross-sectional flow area of the second passage is approximately 5 to 8 times a cross-sectional flow area of the first passage.

15. The fuel injection assembly according to claim 14, wherein the plenum wall extends outboard and tapers gradually to a plenum ceiling that defines an outboard boundary of the plenum;

wherein the plenum ceiling includes an inboard extending flow guide, the flow guide having a center axis approximately aligned with a center axis of the tube;

wherein the flow guide comprising a circular cross-sectional shape that tapers to a distal end; and wherein the flow guide is configured such that the distal end comprises a position inboard of a plane of the first port.

16. The fuel injection assembly according to claim 12, wherein the footprint of the plenum wall includes a rough circular shape;

wherein the footprint of the plenum wall, the first end of the tube, and the first port each comprise a similar rough circular shape; and wherein the footprint of the plenum wall, the first end of the tube, and the first port comprise a concentric arrangement.

17. The fuel injection assembly according to claim 3, wherein, between the first end and the second end, the tube includes a venturi section.

18. The fuel injection assembly according to claim 17, wherein the venturi section includes a converging section that converges to a throat as the venturi section extends inboard;

wherein, as the venturi section extends further inboard from the throat, the venturi section includes a diverging section.

19. The fuel injection assembly according to claim 18, wherein the venturi section is configured such that a plane of the throat is positioned near a plane of the first port.

20. The fuel injection assembly according to claim 3, wherein, between the first end and the second end, the tube comprises a solid structure configured such that a fluid moving through the tube is isolated from a cross flow of fluid moving through the flow annulus; and wherein the plenum is defined by a plenum wall that extends outboard from a footprint on the outer surface of the outer radial wall; and wherein the plenum wall comprises a solid structure configured such that a fluid moving through the plenum is isolated from a fluid moving along the outer surface of the outer radial wall or an outer surface of the plenum wall.

21. The fuel injection assembly according to claim 3, wherein the inner radial wall comprises a liner and the outer radial wall comprises a flow sleeve;

wherein the flow sleeve includes a longitudinally extending fuel passageway formed therein, and wherein the fuel passageway connects to the fuel plenum, wherein the fuel injection assembly comprises a late lean injection system that is configured to inject a mixture of fuel and air within an aft end of a primary combustion chamber defined by the liner; and wherein the flow annulus is configured to carry a supply of compressed air toward a forward end of the combustor.

22. The fuel injection assembly according to claim 3, wherein the inner radial wall comprises a transition piece and the outer radial wall comprises an impingement sleeve.

* * * * *